US008333634B2

(12) United States Patent
Norman et al.

(10) Patent No.: US 8,333,634 B2
(45) Date of Patent: Dec. 18, 2012

(54) FRAMES

(75) Inventors: Casey W. Norman, Andoversford (GB); David Gamlin, Bath (GB)

(73) Assignee: Genie Toys plc (GB)

( * ) Notice: Subject to any disclaimer, the term of this patent is extended or adjusted under 35 U.S.C. 154(b) by 242 days.

(21) Appl. No.: 12/416,633

(22) Filed: Apr. 1, 2009

(65) Prior Publication Data

US 2010/0255753 A1 Oct. 7, 2010

(51) Int. Cl.

| | |
|---|---|
| ***A63H 3/36*** | (2006.01) |
| ***A63H 3/52*** | (2006.01) |
| ***A63H 3/08*** | (2006.01) |
| ***A63H 3/00*** | (2006.01) |

(52) U.S. Cl. ..... 446/98; 446/26; 446/28; 446/268; 446/321; 446/367; 446/370; 2/310; 2/311

(58) Field of Classification Search ..... 446/26, 446/28, 98, 268, 367, 370, 321; 2/310, 311
See application file for complete search history.

(56) References Cited

U.S. PATENT DOCUMENTS

| | | | | | |
|---|---|---|---|---|---|
| 659,685 | A | * | 10/1900 | Miller | 128/100.1 |
| 1,255,677 | A | * | 2/1918 | Wilt | 446/98 |
| 2,028,120 | A | * | 1/1936 | Campbell | 446/98 |
| 2,637,328 | A | * | 5/1953 | Behr | 132/277 |
| 2,675,551 | A | * | 4/1954 | Ser Vaas | 2/52 |
| 2,944,368 | A | * | 7/1960 | O'Brian et al. | 446/98 |
| 3,102,360 | A | * | 9/1963 | Doyle et al. | 446/98 |
| 3,339,208 | A | | 9/1967 | Marbach | |
| 3,668,805 | A | | 6/1972 | Coleman | |
| 4,227,340 | A | * | 10/1980 | Goldfarb et al. | 446/100 |
| 4,286,170 | A | | 8/1981 | Moti | |
| 4,311,260 | A | | 1/1982 | Toy | |
| 4,344,249 | A | * | 8/1982 | Goldfarb et al. | 446/101 |
| 4,394,781 | A | | 7/1983 | Axmann | |
| 4,414,774 | A | * | 11/1983 | Fogarty et al. | 446/98 |
| 4,909,802 | A | | 3/1990 | Ahr et al. | |
| 4,917,278 | A | | 4/1990 | Ventimiglia | |
| 5,021,020 | A | * | 6/1991 | Hambly et al. | 446/73 |
| 5,022,886 | A | * | 6/1991 | Jenkins | 446/268 |
| 5,046,986 | A | * | 9/1991 | Wood et al. | 446/321 |
| 5,186,673 | A | * | 2/1993 | Fogarty et al. | 446/98 |
| 5,347,657 | A | | 9/1994 | Unsell | |
| 5,367,715 | A | | 11/1994 | Leonard et al. | |
| 5,569,234 | A | | 10/1996 | Buell et al. | |
| 5,836,487 | A | | 11/1998 | Lam | |
| 5,902,073 | A | | 5/1999 | Eungard et al. | |

(Continued)

FOREIGN PATENT DOCUMENTS

DE 2 123 668 A1 11/1972

(Continued)

OTHER PUBLICATIONS

Barbie, "Snap 'N Play," printout from website http://ecx.images-amazon.com/images/1/51xUQwW6imL.jpg, printed on Mar. 2, 2009.

*Primary Examiner* — Gene Kim
*Assistant Examiner* — Alexander Niconovich
(74) *Attorney, Agent, or Firm* — DLA Piper LLP (US)

(57) ABSTRACT

The disclosure relates to frames useful for affixing a garment to figurines such as dolls. In particular, the disclosure relates to play sets comprising a frame of the disclosure and a figurine such as a doll.

11 Claims, 7 Drawing Sheets

U.S. PATENT DOCUMENTS

| | | | | |
|---|---|---|---|---|
| 6,170,721 | B1 | 1/2001 | Chen | |
| 6,227,930 | B1 * | 5/2001 | Norman et al. | 446/268 |
| 6,241,576 | B1 | 6/2001 | Hofer | |
| 6,568,986 | B2 * | 5/2003 | Kobayashi | 446/268 |
| 6,613,033 | B1 | 9/2003 | Popp et al. | |
| 6,855,029 | B2 * | 2/2005 | Rothman | 450/36 |
| 7,448,932 | B2 * | 11/2008 | Buckley et al. | 446/83 |
| 7,731,563 | B2 * | 6/2010 | Saucier | 446/487 |
| 2001/0016465 | A1 * | 8/2001 | Norman et al. | 446/268 |
| 2002/0102906 | A1 | 8/2002 | Fleisch et al. | |
| 2002/0164923 | A1 | 11/2002 | Marine | |
| 2002/0168918 | A1 | 11/2002 | Marine | |
| 2002/0195862 | A1 | 12/2002 | Kelly et al. | |
| 2004/0143885 | A1 | 7/2004 | Rothman | |
| 2004/0222252 | A1 | 11/2004 | Gouldson et al. | |
| 2006/0099876 | A1 * | 5/2006 | Buckley et al. | 446/83 |
| 2006/0264859 | A1 | 11/2006 | Tsuji et al. | |
| 2007/0049897 | A1 | 3/2007 | LaVon et al. | |
| 2007/0118953 | A1 | 5/2007 | Strauss et al. | |
| 2007/0194062 | A1 | 8/2007 | Rediin | |
| 2010/0041301 | A1 * | 2/2010 | Phillips | 446/98 |
| 2010/0077661 | A1 | 4/2010 | Brandstätter | |
| 2010/0255753 | A1 * | 10/2010 | Norman et al. | 446/268 |

FOREIGN PATENT DOCUMENTS

| | | | |
|---|---|---|---|
| DE | 72 04 415 | U1 | 7/1975 |
| DE | 78 38 407 | U1 | 12/1978 |
| DE | 30 01 421 | A1 | 7/1981 |
| DE | 31 24 179 | A1 | 12/1982 |
| DE | 86 16 678 | U1 | 12/1986 |
| DE | 90 01 213 | U1 | 4/1990 |
| DE | 92 06 426 | U1 | 7/1992 |
| DE | 299 08 209 | U1 | 12/1999 |
| DE | 20 2004 010 174 | U1 | 10/2004 |
| DE | 20 2005 007 381 | U1 | 5/2005 |
| DE | 20 2004 019 938 | U1 | 9/2005 |
| EP | 0 178 489 | A1 | 4/1986 |
| EP | 0 307 715 | A1 | 3/1989 |
| EP | 0 893 150 | B1 | 1/1999 |
| FR | 2 481 893 | A1 | 11/1981 |
| FR | 2 692 445 | B1 | 12/1993 |
| FR | 2 697 142 | A1 | 4/1994 |
| GB | 172916 | A | 12/1921 |
| GB | 244899 | A | 12/1925 |
| GB | 419261 | A | 11/1934 |
| GB | 619860 | A | 3/1949 |
| GB | 620931 | A | 4/1949 |
| GB | 635459 | A | 4/1950 |
| GB | 636036 | A | 4/1950 |
| GB | 655178 | A | 7/1951 |
| GB | 709741 | A | 6/1954 |
| GB | 757093 | A | 9/1956 |
| GB | 760366 | A | 10/1956 |
| GB | 794103 | A | 4/1958 |
| GB | 882919 | A | 11/1961 |
| GB | 1077099 | A | 7/1967 |
| GB | 1107946 | A | 3/1968 |
| GB | 1137534 | A | 12/1968 |
| GB | 1 294 637 | A | 11/1972 |
| GB | 1 381 415 | A | 1/1975 |
| GB | 1 385 653 | A | 2/1975 |
| GB | 1 430 513 | A | 3/1976 |
| GB | 1 518 830 | A | 7/1978 |
| GB | 8502021 | A | 2/1987 |
| GB | 2 206 783 | A | 1/1989 |
| GB | 2 262 224 | A | 6/1993 |
| GB | 1 082 055 | A | 9/1997 |
| WO | 99/60967 | A1 | 12/1999 |
| WO | 00/41589 | A2 | 7/2000 |
| WO | 2005/065474 | A2 | 7/2005 |
| WO | 2009/141480 | A1 | 11/2009 |

* cited by examiner

FRAMES

TECHNICAL FIELD

This disclosure relates to frames useful for affixing a garment to figurines such as dolls. The disclosure also relates to play sets comprising a frame of the disclosure and a figurine such as a doll.

BACKGROUND

Children report again and again that a frustrating aspect of fashion dolls is the time and difficulty in dressing and changing the clothing for their dolls. Attempts to overcome this have often resulted in clothing that lacks the realism and style of the best fabric garments.

Thus, a need exists for frames and play sets that permit garments to be quickly pressed, or snapped onto, and pulled off figurines such as dolls, in seconds without difficulty or the need for additional fastening means.

SUMMARY

We thus provide frames comprising a ring having two ring ends, first members extending upwardly from the ring and connected to the ring ends, second members extending over a plane passing through the circumference of the ring and which are connected to the first members, and two hooks having shank portions and bend portions, with the shank portions extending upwardly from the portions of the second members located distal to the connections between the first members and second members and the bend portions extending from the shank portions to form termini.

The frames provided have different designs and uses and can be used with dolls of different scales. This is aided by the addition of at least one hinge. Importantly, such hinges can be built into the frame as part of the molding process with negligible additional cost.

The frames of FIGS. 1, 2, 3, 4 and 5, for example, are typically large frames for use with larger dolls. The frames of FIGS. 6, 7 and 10 are typically small frames for use with smaller dolls. The frames of FIGS. 8 and 9 comprise built-in hinges and a spring which make it easier to put these frames onto a doll. The frames of FIGS. 11 and 12 also comprise built-in hinges and springs which make it easier to put these frames onto a doll.

DETAILED DESCRIPTION

Figure 1:
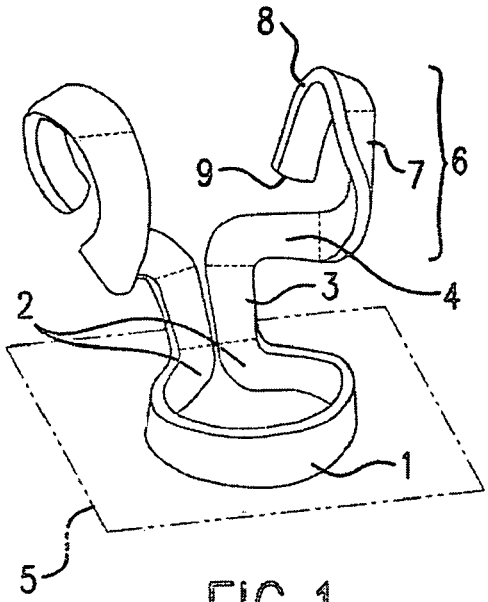
FIG. 1 shows, from a frontal perspective, a frame. Typically, this is a large frame for use with larger dolls.
Figure 2:
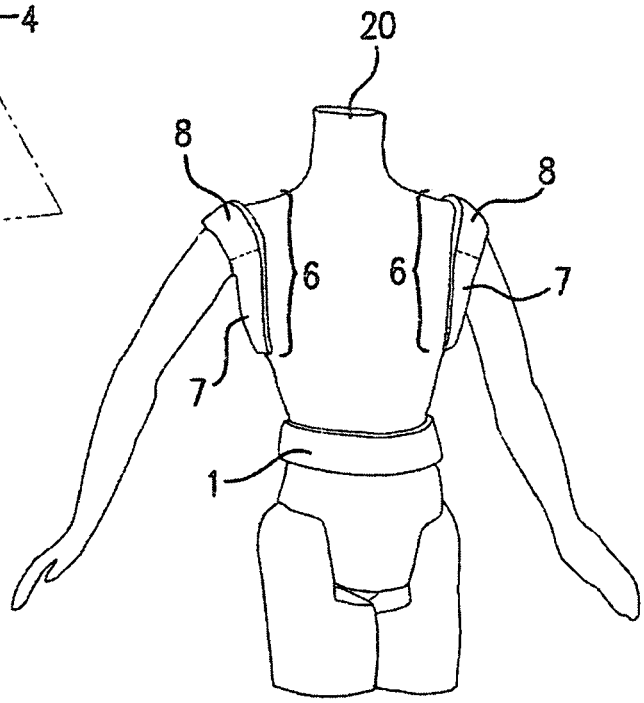
FIG. 2 shows, from a frontal perspective, a frame engaged to the body of a figurine. Typically, this is a large frame for use with larger dolls.
Figure 3:
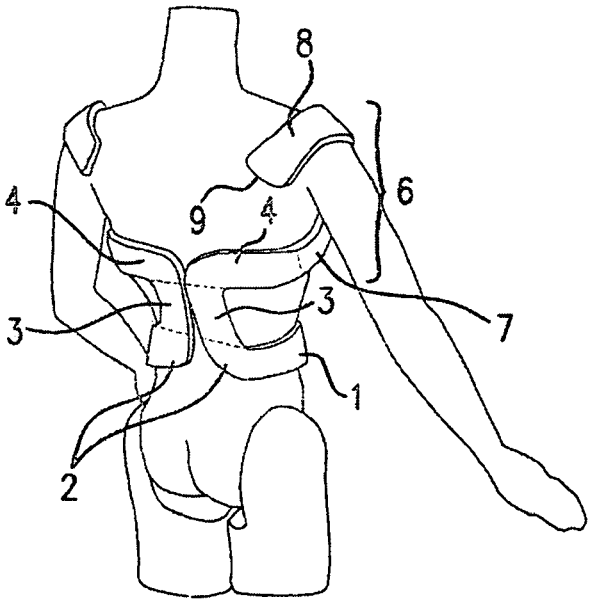
FIG. 3 shows, from a rear perspective, a frame engaged to a figurine. Typically, this is a large frame for use with larger dolls.
Figure 4:
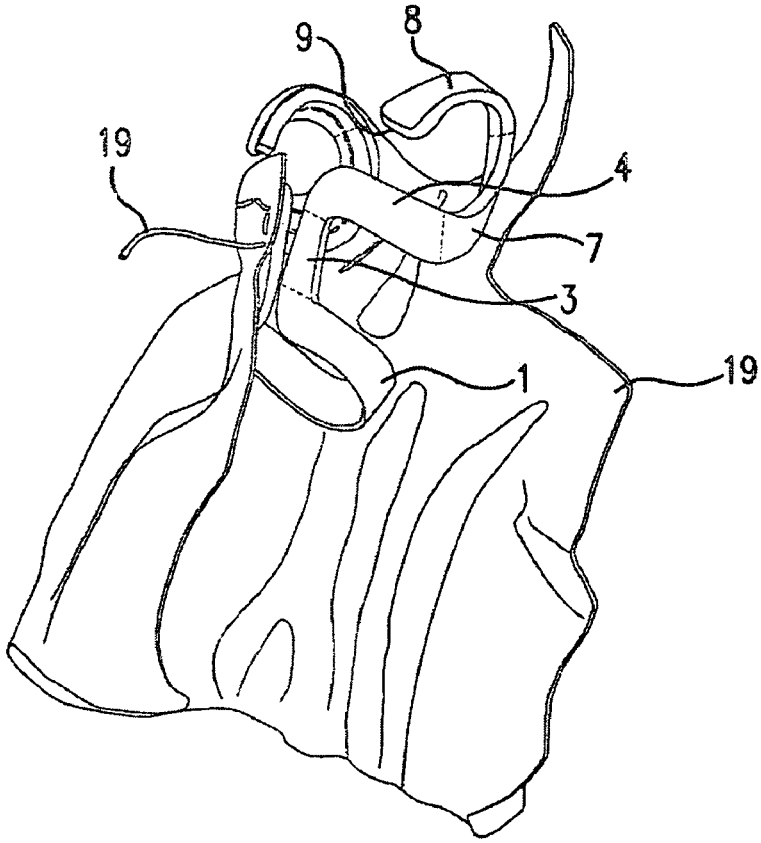
FIG. 4 shows, from a side perspective, a frame connected to at least one second material forming a portion of a garment. Typically, this is a large frame for use with larger dolls.

It will be appreciated that the following description is intended to provide details concerning specific representative aspects of the disclosure. Additionally, all publications, including but not limited to patents and patent applications, cited in this disclosure are herein incorporated by reference as though fully set forth.

We provide frames comprising a split ring 1 having two ring ends 2, first members 3 extending upwardly from the ring 1 and connected to the ring ends 2, second members 4 extending over a plane 5 passing through the circumference of the ring 1 and which are connected to the first members 3, and two hooks 6 having shank portions 7 and bend portions 8, with the shank portions 7 extending upwardly from the portions of the second members located distal to the connections between the first members 3 and second members 4 and the bend portions 8 extending from the shank portions to form termini. Examples of representative structures can be seen in FIGS. 1-4 and 6-12. Importantly, it is preferred that the frames be molded in one piece from an appropriate material.

It will be recognized the frames may consist essentially of, or consist of, the elements disclosed as portions of the frame. Those of ordinary skill in the art will also recognize the split ring 1 comprises two distinct portions, or halves, which include a front portion located substantially opposite of the two ring ends 2 and a back portion which includes the two ring ends 2. As those of ordinarily skill in the art will also recognize, the split ring 1 may be provided in a circular geometry, elliptical geometry or any other geometry (e.g. angular) sufficient to engage a body such as that of a figurine. Additionally, those of ordinary skill in the art will recognize the elements of the frame, including the rings, may have a variety of different cross sections including circular, elliptical, rectangular and variations on these or other geometries. These other geometries for split ring 1 or the frames may be necessary to fit different figurine, such as doll, body shapes as required.

In examples as seen in FIGS. 6-12, the frame further comprises a surface 10 connected to the ring 1, the first members 3, the second members 4 and the shank portions 7 and which has an upper edge 11 extending between the shank portions 7.

Those of ordinary skill in the art will recognize that the surface 10 may be flat, curved, or have any complex topology necessary to accommodate and engage the features of a figurine such as a doll.

In another example of the frame, the surface 10 comprises at least one hinge 12 on an axis 13 extending from the ring 1 to the upper edge 11 of the surface and a substantially arcuate spring 14 spanning the axis 13 and having spring ends 15 flexibly connected to the surface 10 on either side of the axis 13. Representative examples of such structures can be seen in FIGS. 8 and 9. Importantly, it is preferred that, in these frames, a hinge and spring can be built into the frame so the whole can be molded in one piece from the appropriate material.

The hinge 12 may be formed by a variation in the thickness of the materials of the frame. Alternatively, a hinge 12 may be formed by other means such as rings, straps, or any other hinge type or hinge means which will be readily recognized by those of ordinary skill in the art.

Those of ordinary skill in the art will also recognize that the upper edge 11 of the surface 10 may have any geometry such as a line, curve or variations on these.

A substantially arcuate spring 14 may be present. Such springs have geometries which include at least one portion of the circumference of a circle or a portion of another curve capable of storing and releasing mechanical energy. The spring ends 15 may be flexibly connected by means of straps, rings, resilient polymers, flexible materials or any other type of connection which may be rendered flexible. Again, it is preferred that, in these frames, a spring can be built into the frame so the whole can be molded in one piece from an appropriate material and so the spring can be part of the one piece molding.

At least one hinge 12 may extend through the ring 1. Examples can be seen in FIGS. 8 and 9.

In another example, the frame comprises at least one hinge 12 on a pair of axes 16 extending from the ring 1 through the second members 4, substantially arcuate springs 14 spanning the axes 16 and having first spring ends 17 and second spring ends 18, wherein the first spring ends 17 are flexibly connected to the surface 10 on either side of the axes 16 and the second spring ends 18 are flexibly connected to the first member 3. Examples can be seen in FIGS. 11 and 12.

In another example, at least one hinge 12 extends though the ring 1. Such structures can be seen in FIGS. 11 and 12.

In another example, the frame is comprised of a resilient material.

A resilient material is one that is capable of withstanding shock or being placed into a different geometry without permanent deformation or rupture. Resilient materials may be constructed from polymers, metals, or combinations of these. Examples of such polymers include but are not limited to polypropylene, polyethylene, polyvinylchloride, acrylonitrile butadiene styrene, polystyrene and the like or combinations of these. Examples of such polymers also include polymers of the elastomer type. It is preferred that polypropylene and polyethylene be used for frames comprising a hinge and that polyvinylchloride, acrylonitrile butadiene styrene and polystyrene be used for frames without such a hinge. Frames without the hinge may also be made from polypropylene or polyethylene, but the other materials described above may also be chosen. Ideally, such resilient materials will spring back into their original shape and hold that shape firmly so the frames do not fall off when engaged to the body of a figurine such as a doll. Those of ordinary skill in the art will readily recognize other suitable resilient materials including composite materials such as combinations of metals and polymers in a mesh form.

Figure 5:
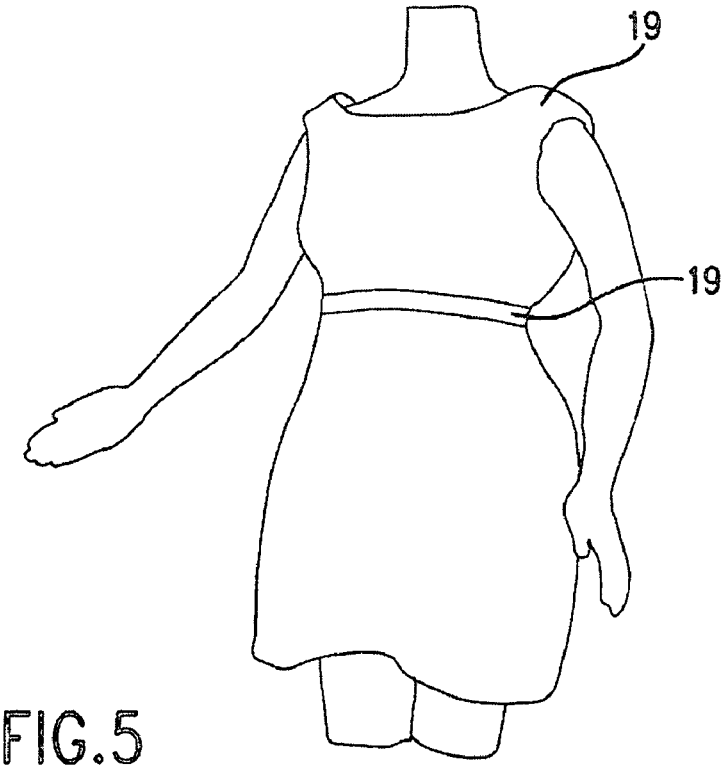
FIG. 5 shows, from a frontal perspective, a garment comprising a frame engaged to a figurine. Typically, this is a large frame for use with larger dolls.
Figure 6:
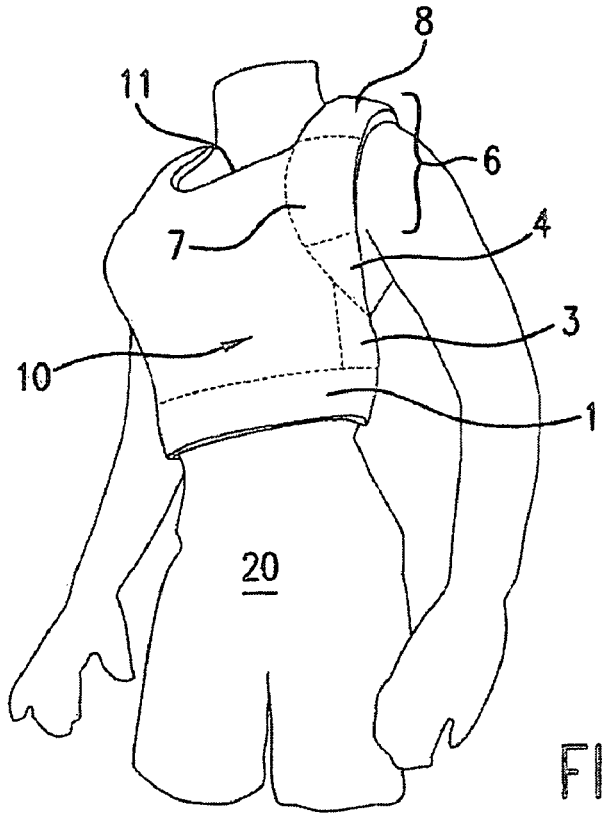
FIG. 6 shows, from a side perspective, a frame engaged to a figurine. Typically, this is a small frame for use with smaller dolls.
Figure 7:
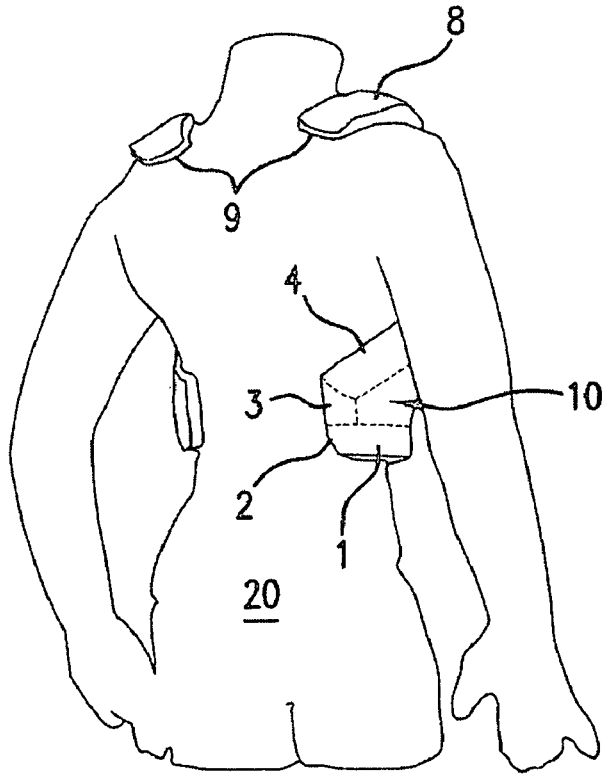
FIG. 7 shows, from a rear perspective, a frame engaged to a figurine. Typically, this is a small frame for use with smaller dolls.
Figure 8:
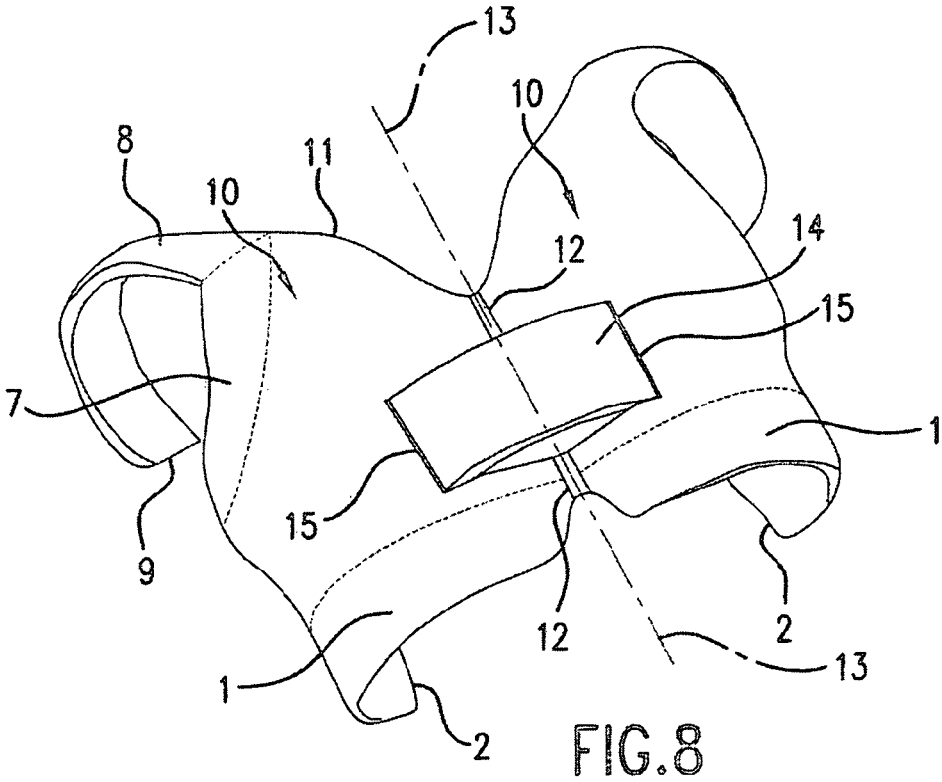
FIG. 8 shows, from a frontal perspective, a frame in an open conformation. Typically, the frames comprise built-in hinges and a spring which make it easier to put these frames onto a doll.
Figure 9:
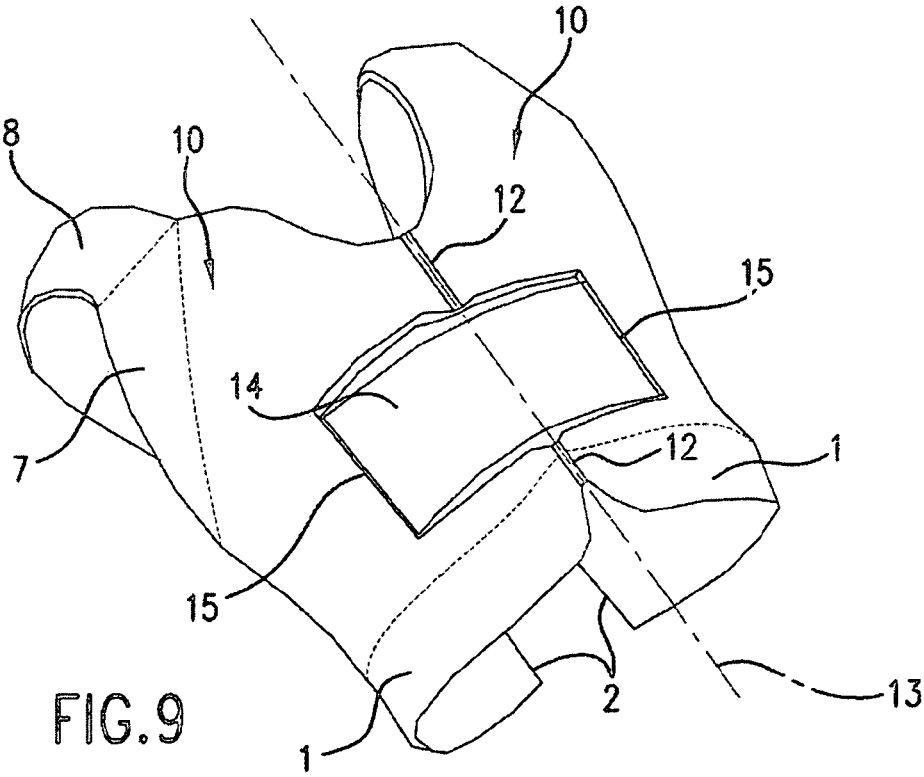
FIG. 9 shows, from a frontal perspective, a frame in a closed conformation suitable for engagement to a figurine. Typically, the frames comprise the built-in hinges and a spring which make it easier to put these frames onto a doll.
Figure 10:
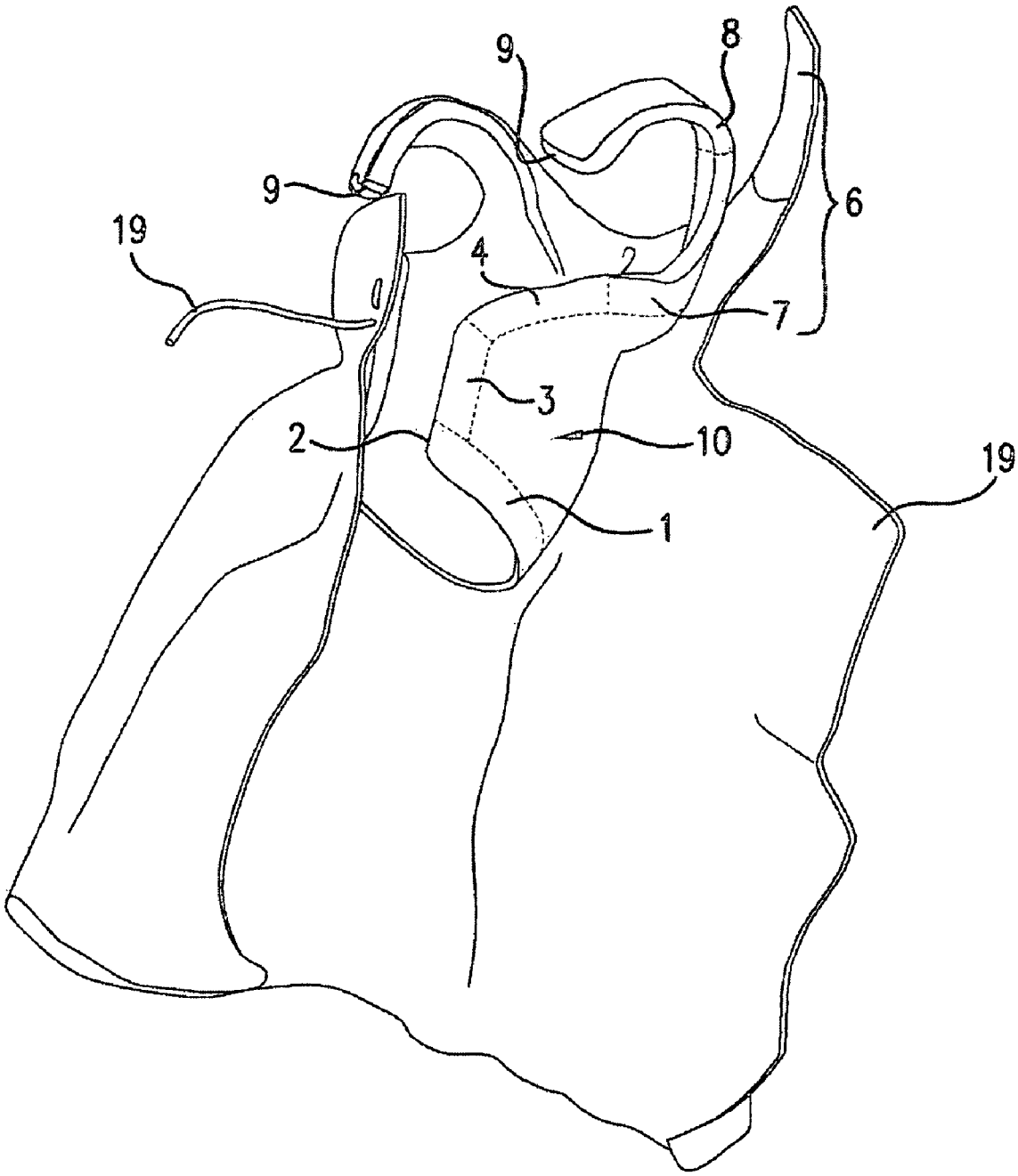
FIG. 10 shows, from a side perspective, a frame connected to at least one second material forming a portion of a garment. Typically, this is a small frame for use with smaller dolls.
Figure 11:
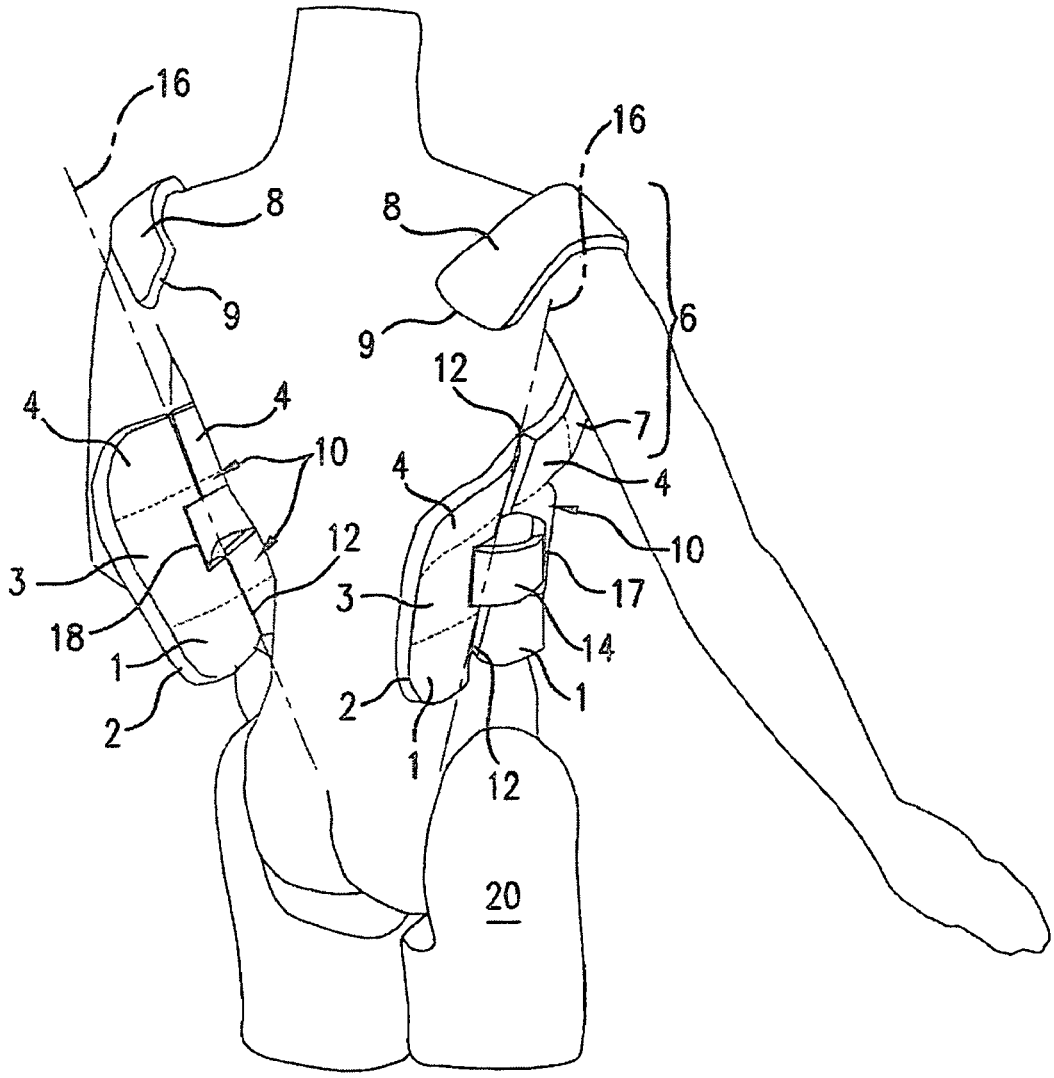
FIG. 11 shows, from a rear perspective, a frame before engagement to a figurine. Typically, the frames comprise built-in hinges and springs which make it easier to put these frames onto a doll.
Figure 12:
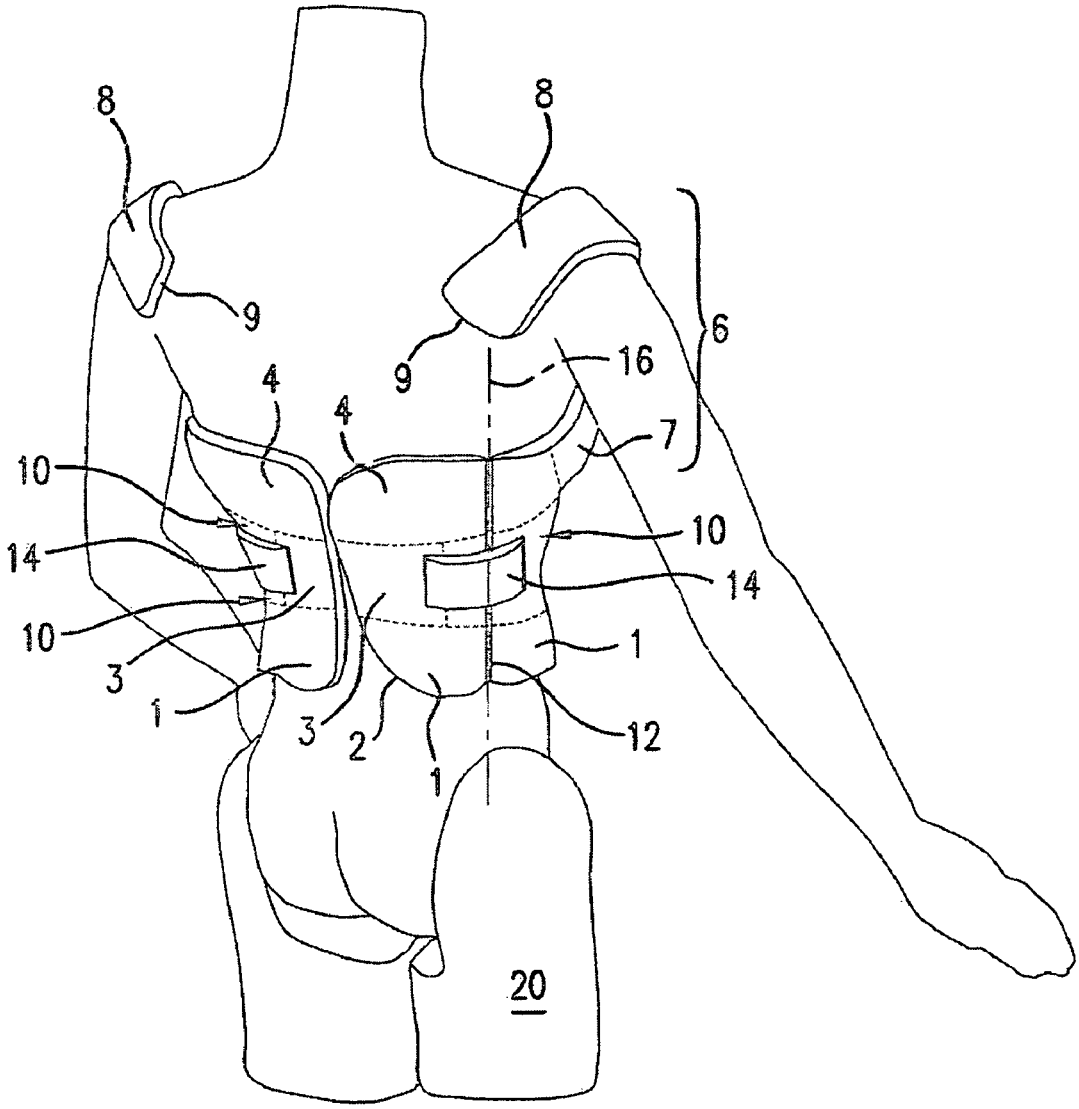
FIG. 12 shows, from a rear perspective, a frame engaged to a figurine. Typically, the frames comprise built-in hinges and springs which make it easier to put these frames onto a doll.

In another example, the frame may be connected to at least one second material 19 forming a portion of a garment. Importantly, when the frame is connected to a second material, this can form an entire garment. Examples can be seen in FIGS. 4, 5 and 10.

This second material may be a fabric, leather, polymer or any other material which may be used to form a portion of a garment. Such garments may include but are not limited to clothing items, bags, or other accessories worn on a body such as, for example, the body of a figurine or doll. Additionally, such garments may also include costumes and outfits that transform a figurine such as a doll or animal figurine.

The frame can be connected to the at least one second material 19 forming a portion of a garment by any mechanical or chemical means. Examples of such mechanical means include stitching, buttons, hook-and-loop fasteners, heat welds and the like. Examples of chemical means include chemical cross-linking of materials and glues (e.g. polymerizable glues) and the like. Those of ordinary skill in the art will recognize numerous other means by which to connect the disclosed frames and at least one second material 19 forming a portion of a garment.

Such a garment may be a blouse, dress or other garment which extends around the back of a body such as a figurine and allows the blouse, dress or other garment to be effectively closed off at the back of the figurine.

We also provide a play set comprising the frame engaged to the body 20 of a figurine. Examples can be seen in FIGS. 2, 3, 5-7 and 12.

The frame may be engaged to the body of the figurine by adjusting the springs and/or other elements of the frames to surround and embrace the body of the figurine. The frames may be engaged to the body of a figurine by any mechanism. However, there are three preferred mechanisms. One such mechanism involves simply flexing the frames apart by hand and then allowing them to snap back around the body and shoulders of a figurine such as a doll. A second such mechanism involves changing the shape of the termini 9 and the first members 3 so these have a curved shape that makes it possible to push the frames directly onto the body of a figurine. In a third such mechanism, the hinge and spring in the frames allow the frames to be placed in an open configuration and remain in an open configuration, or to be placed in a closed configuration and remain in a closed configuration so the frames can be placed onto a figurine and then snapped closed. In each of the above mechanisms, one can simply pull the frames, or garments comprising the frames, off a figurine by pulling on almost any part of them.

The play set figurine may be a doll. Examples can be seen in FIGS. 2, 3, 5-7 and 12.

The doll may be, for example, any small scale figure of a human or other animal, real or imagined, which is used as a child's play thing or for any other purpose. Examples of such dolls include well known dolls sold under the BARBIE™ or BRATZ™ names or any other doll. Additionally, the dolls sold under the POLLY POCKET™ name are an example of a smaller doll for which the smaller frames disclosed herein are more appropriate.

Although the apparatus and methods have been described in connection with specific forms thereof, it will be appreciated that a wide variety of equivalents may be substituted for the specified elements described herein without departing from the spirit and scope of this disclosure as described in the appended claims.

What is claimed is:

1. A play set comprising a one-piece molded frame which comprises:

a split ring having two ring ends, first members extending upwardly from the ring and connected to the ring ends, second members extending over a plane passing through the circumference of the ring and which are connected to the first members, and two hooks having shank portions and bend portions, with the shank portions extending upwardly from the portions of the second members located distal to the connections between the first members and second members and the bend portions extending from the shank portions to form termini;

a hinge and a substantially arcuate spring integrated and molded into the frame such that the frame can be placed in an open configuration and remain in the open configuration and be placed in a closed configuration and remain in a closed configuration, and the arcuate spring having a substantially curved cross-section and a surface defining a width and a length, the length defined by spring ends, and an aperture formed in the frame and spanning the hinge, the aperture having a length and width wherein the length and width of the aperture are configured to receive the length and width of the arcuate spring.

2. The play set of claim 1, wherein the frame further comprises a surface connected to the ring, the first members, the second members and the shank portions and which has an upper edge portion extending between the shank portions.

3. The play set of claim 2, wherein the hinge is located on an axis extending from the ring to the upper edge portion of said surface and the substantially arcuate spring spanning said axis and having the spring ends flexibly connected to the surface on either side of said axis by at least one selected from the group consisting of a strap, a ring, a flexible material or a resilient polymer.

4. The play set of claim 3, wherein the hinge extends through the ring.

5. The play set of claim 2, comprising a second hinge, wherein each hinge is on one of a pair of axes extending from the ring through the second members, substantially arcuate springs spanning said axes and having first spring end portions and second spring end portions, wherein the first spring end portions are flexibly connected to the surface on either side of said axes by at least one selected from the group consisting of a strap, a ring, a flexible material or a resilient polymer and the second spring end portions are flexibly connected to the first member by at least one selected from the group consisting of a strap, a ring, a flexible material or a resilient polymer.

6. The play set of claim 5, wherein each hinge extends through the ring.

7. The play set of claim 1, wherein the frame comprises a resilient material.

8. The play set of claim 1, wherein the frame engages at least a body portion of a figurine.

9. The play set of claim 1, wherein the frame engages at least a body portion of a figurine and the material, together with the frame and the figurine, form an entire garment worn by the figurine.

10. The play set of claim 1, wherein the hinge comprises a variation in a thickness of the frame.

11. The play set of claim 1, further comprising a material that at least forms a portion of a garment and is removably attachable to the frame.

* * * * *